US008302749B2

(12) United States Patent
Melmon et al.

(10) Patent No.: US 8,302,749 B2
(45) Date of Patent: Nov. 6, 2012

(54) PROTECTIVE TRANSPORT BAG

(75) Inventors: Bradley S. Melmon, Seattle, WA (US); Ryan H. Mongan, Sammamish, WA (US); David J. Law, Seattle, WA (US); Parker T. Chou, Seattle, WA (US); Graeme Esarey, Seattle, WA (US)

(73) Assignee: Daymen Canada Acquisition ULC, Vancouver, British Columbia (CA)

( * ) Notice: Subject to any disclaimer, the term of this patent is extended or adjusted under 35 U.S.C. 154(b) by 988 days.

(21) Appl. No.: 12/235,481

(22) Filed: Sep. 22, 2008

(65) Prior Publication Data

US 2009/0250362 A1 Oct. 8, 2009

Related U.S. Application Data

(60) Provisional application No. 61/123,152, filed on Apr. 7, 2008.

(51) Int. Cl.
*A45C 3/08* (2006.01)

(52) U.S. Cl. ..... 190/110; 190/100; 190/109; 190/102; 190/107; 150/103; 150/104; 150/105; 150/106; 150/107; 206/316.2; 206/315.4; 224/153; 224/583; 224/585

(58) Field of Classification Search ..... 190/110, 190/109, 100, 103, 104, 106, 107, 111; 150/103, 150/104, 107; 383/3, 6, 40, 59; 219/770; 224/151
See application file for complete search history.

(56) References Cited

U.S. PATENT DOCUMENTS

| | | | | |
|---|---|---|---|---|
| 3,920,179 | A * | 11/1975 | Hall | 604/317 |
| 4,854,736 | A * | 8/1989 | McVeigh | 383/76 |
| 4,961,522 | A * | 10/1990 | Weber | 224/585 |
| 5,240,106 | A | 8/1993 | Plath | |
| 6,353,215 | B1 * | 3/2002 | Revels et al. | 219/770 |
| 6,820,664 | B1 * | 11/2004 | Ritch | 150/103 |
| 2002/0028029 | A1 * | 3/2002 | Revels et al. | 383/6 |
| 2006/0260046 | A1 | 11/2006 | Landay | |

OTHER PUBLICATIONS

International Search Report in International Application No. PCT/US08/77270, dated Nov. 28, 2008.

* cited by examiner

*Primary Examiner* — Anthony Stashick
*Assistant Examiner* — Cynthia Collado
(74) *Attorney, Agent, or Firm* — Medler Ferro PLLC

(57) ABSTRACT

The invention relates generally to bags and cases for storage of cameras or other objects. More specifically, the system integrates a waterproof dry bag component optimized for storage of cameras and camera accessories, with a bag component of substantially the same size and shape of the dry bag into a single unit. When separated, the two components can perform as individual units.

14 Claims, 6 Drawing Sheets

PROTECTIVE TRANSPORT BAG

CROSS REFERENCE TO PRIORITY AND RELATED APPLICATIONS

This application claims priority benefit to provisional application, U.S. Application No. 61/123,152, filed Apr. 7, 2008, entitled "Protective Camera Transport Bag."

This application is related to the following co-pending applications, with the same inventors, and the same assignee. The teaching of the following application listed below is herein incorporated by reference:

U.S. application Ser. No. 12/235,487, filed Sep. 22, 2008, entitled "Protective Camera Enclosure."

FIELD OF THE INVENTION

The invention relates generally to bags and cases for storage of cameras or other objects.

BACKGROUND OF THE INVENTION

Camera bags and cases are common and range from simple cases supplied by camera manufacturers to correspond to a particular model of camera, to bags and full-sized suitcases with multiple compartments adapted to take varying sizes of cameras, lenses, filters, flashes, lighting equipment and other accessories useful to professional and serious amateur photographers.

Professional photographers working outside a portrait studio require fast, convenient and sequential access to the contents of their bags and cases. These photographers also consider mobility, flexibility and versatility important overall characteristics that must be part of the design and manufacture of the cases and bags that they invest in.

Protection of equipment is also a high priority to photographers, and even more so for photographers that work in extreme environmental conditions. Water, sand, dust, and dirt are some of the hazards posed by the environment to cameras and camera equipment. Protection from these hazards is critical to a photographer traveling through these environmental conditions.

In accordance to a preferred embodiment of the invention, a bag equipped with a separate, but fully integrated dry bag features the desired qualities and characteristics described above.

For the sake of simplicity, the invention is described in detail for usage with cameras, camera equipment and accessories. Nevertheless, the invention described herein can apply to usage with any object or device that requires protection from environmental conditions, and as such, the teaching is the same for each application.

SUMMARY OF THE INVENTION

The invention describes a protective bag for an electronic or optical device such as a camera and its related accessories. The bag provides protection from several sources: environmental (e.g. rain, sand, or dirt), user abuse (e.g. scratching or excessive physical shock or vibration), and wear from excessive usage. The invention also provides for a convenient method of carrying the equipment, yet at the same time, allows the user easy access to the equipment.

In accordance with one embodiment of the invention, the system combines an exterior enclosure with an internal waterproof enclosure. The system seamlessly integrates the waterproof enclosure within an exterior carrier bag as a single unit.

In accordance with another embodiment of the invention, the system integrates a waterproof dry bag component optimized for storage of cameras and camera accessories, with a sling bag component of substantially the same size and shape of the dry bag into a single unit. In accordance with one embodiment of the invention, the dry bag features a roll top closure. The dry bag includes quick release buckles at each end of the roll top and a set of quick release buckles at each end of the bottom the dry bag mated with the buckles from the roll top. The sling bag of substantially the same size and shape of the dry bag features pre-manufactured with openings to accept the bottom buckles from the dry bag. When the bottom buckles of the dry bag are pulled taut through the openings, the dry bag is seated into the sling bag. As such, the two components, a sling bag and a dry bag are designed to be seamlessly integrated for use as a single unit. When separated, the two components can perform as individual units.

It should be noted that although a preferred embodiment of the system is described herein as a sling bag and waterproof dry bag, it is contemplated within the scope of the invention that the system may be adapted for use with any two bags or cases, including but not limited to the following: bags, satchels, purses, suitcases, hard cases, soft cases, backpacks, side packs, hip packs, fanny packs, sling bags, messenger bags, rolling bags, and rolling backpacks.

BRIEF DESCRIPTION OF THE DRAWINGS

The drawings illustrate the design and utility of embodiments of the invention, in which similar elements are referred to by common reference numerals and in which.

DETAILED DESCRIPTION

Figure 1:
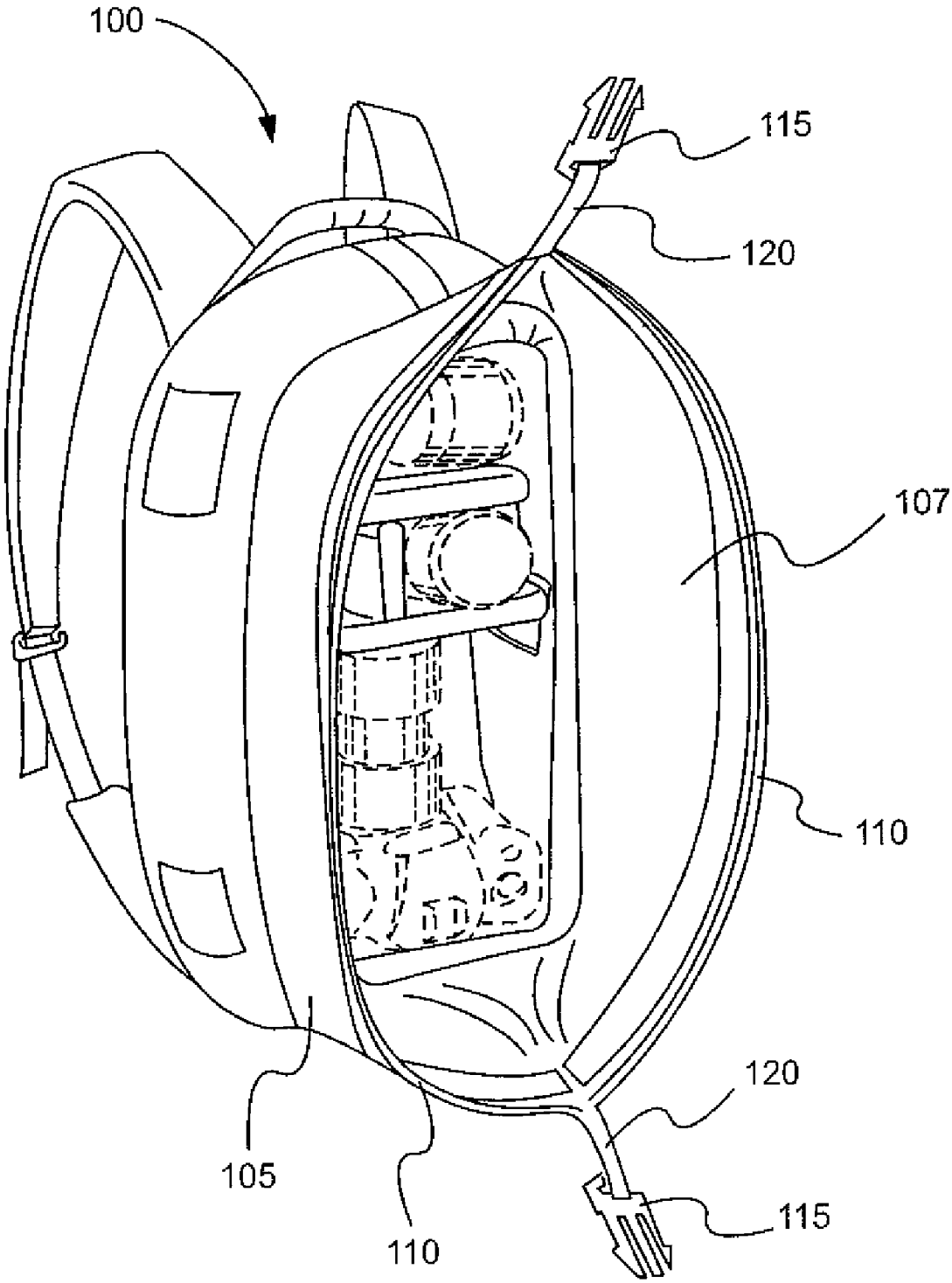
FIG. 1 illustrates a backpack and integrated waterproof dry bag with roll top in an open position in accordance with one embodiment of the invention.

Various embodiments of the invention are described herein with reference to the figures. It should be noted that the figures are not drawn to scale and elements of similar structures or functions are represented by like reference numerals throughout the figures. It should also be noted that the figures are only intended to facilitate the description of specific embodiments of the invention. The embodiments are not intended as an exhaustive description of the invention or as a limitation on the scope of the invention. In addition, an aspect described in conjunction with a particular embodiment of the invention is not necessarily limited to that embodiment and can be practiced in any other embodiment of the invention.

Turning to the drawings, FIG. 1 illustrates backpack 100 and an integrated waterproof dry bag 105 with roll top 107 in an open position in accordance with one embodiment of the invention. As shown, dry bag 105 features compartment storing for cameras and camera accessories, but the internal configuration can be designed to suit any desired functionality or aesthetic. In a preferred embodiment of the invention, dry bag 105 is of substantially the same size and shape as backpack 100.

Seal 110 sits across both sides of the opening. To ensure that the opening of dry bag 105 is watertight and waterproof, first, the top opening is brought together via seal 110, which forms a band across the top of dry bag 105. Seal 110 may include, but is not limited to: Velcro®, magnets, clips, snaps, latches, tension mechanism, pressure mechanism, locks, cables, or any other sealing mechanism or structure. Second, the band is then rolled over at roll top 107 several times to create an air tight seal. Dry bag 105 also features top buckles 115 and top straps 120 and bottom buckles 125 (not shown in FIG. 1) and bottom straps 130 (not shown in FIG. 1).

Figure 2:
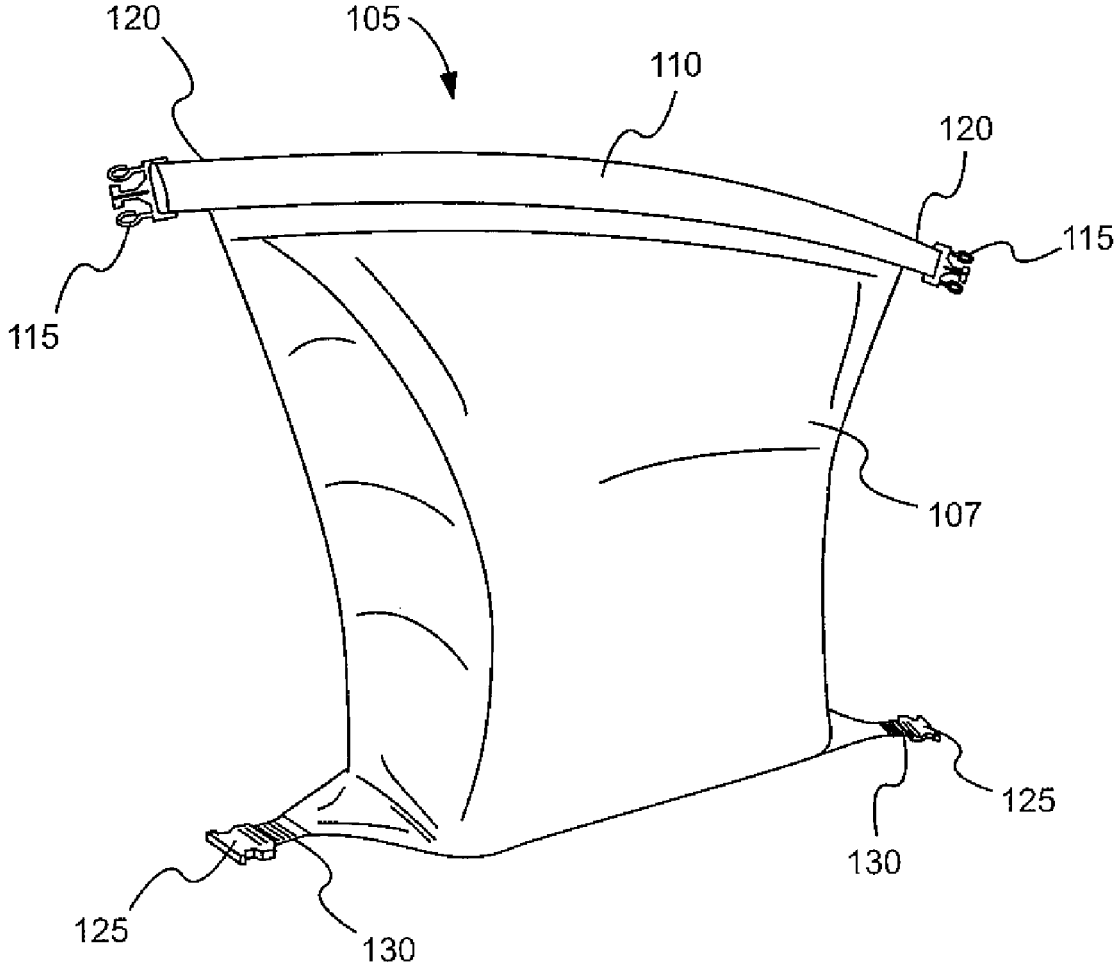
FIG. 2 illustrates a dry bag in stand alone configuration in accordance with one embodiment of the invention.

FIG. 2 illustrates dry bag 105 in stand alone configuration in accordance with one embodiment of the invention. When fully extended, the top of the dry bag is flared upward and outward. Dry bag 105 may remain in the exterior enclosure or it may be removed by the user. The user may remove dry bag 105 for cleaning, replace it with a different pre-configured waterproof bag, or to use the exterior enclosure (e.g. backpack 100) without dry bag 105 present.

Dry bag 105 is an elastomer or elastomer-impregnated fabric and is well known in the art. As is typical of modern waterproof bags, dry bag 105 utilizes either no stitching or a minimal amount of stitching if required. Any form of stitching introduces puncture holes in the material, a potential source of leaks or cracks, thereby defeating the air tight requirement of a waterproof bag. In lieu of sewing, material is often bonded with adhesive or the material is melted together with other similar materials. However, any known methods of manufacturing a waterproof bag in the industry may be used to produce dry bag 105 described herein.

As shown in FIG. 2, dry bag 105 features roll top 107 and seal 110 as the core components for waterproofing the bag at the opening. In accordance with one embodiment of the invention, the top opening extends the entire width of the bag. Alternatively, as shown in FIG. 2, the sides may flare outward as they approach the top, thereby creating a larger opening and more convenient access to the interior of dry bag 105. To seal the bag, the top opening is brought together via seal 110, forming a band across the top of dry bag 105 at roll top 107. Roll top 107 is rolled over several times, creating a waterproof barrier. Top buckles 115, connected to the bag by top straps 120 on either end of roll top 107 are drawn down to the sides of dry bag 105. Top buckles 115 are fastened to bottom buckles 125, connected to the bag by bottom straps 130. By drawing the ends down tightly to the sides of dry bag 105, the waterproof barrier created by seal 110 and roll top 107 is substantially increased. Top straps 120 and bottom straps 130 may be made adjustable in length if so desired, which would allow the ends of dry bag 105 to be drawn together further, making the top more secure. In an alternative embodiment, top buckles 115 can be drawn together to complete closure of the top opening, and additionally, create a handle for dry bag 105.

Top buckles 115 and bottom buckles 125 may be replaced with any other type of fastening means, including but not limited to the following: magnetic mechanism, buckles, clips, snaps, latches, hooks, friction mechanism, tension mechanisms, locks, cable ties, Velcro®, or any other similar type of fastening mechanism or structure.

Figure 3B:
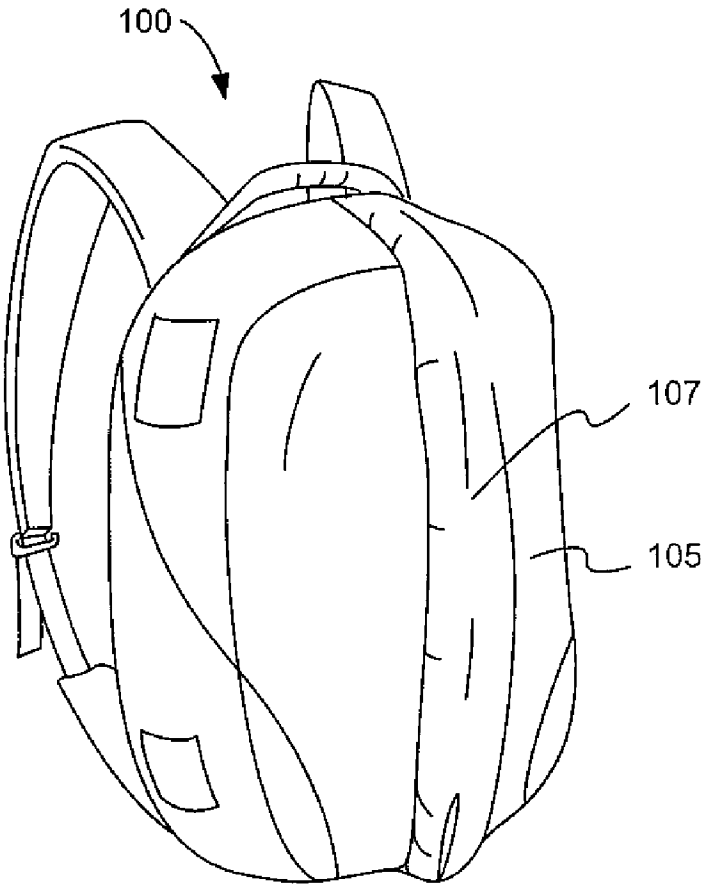
FIGS. 3A and 3B illustrates a backpack and integrated waterproof dry bag with roll top in open and closed positions in accordance with one embodiment of the invention.
Figure 3A:
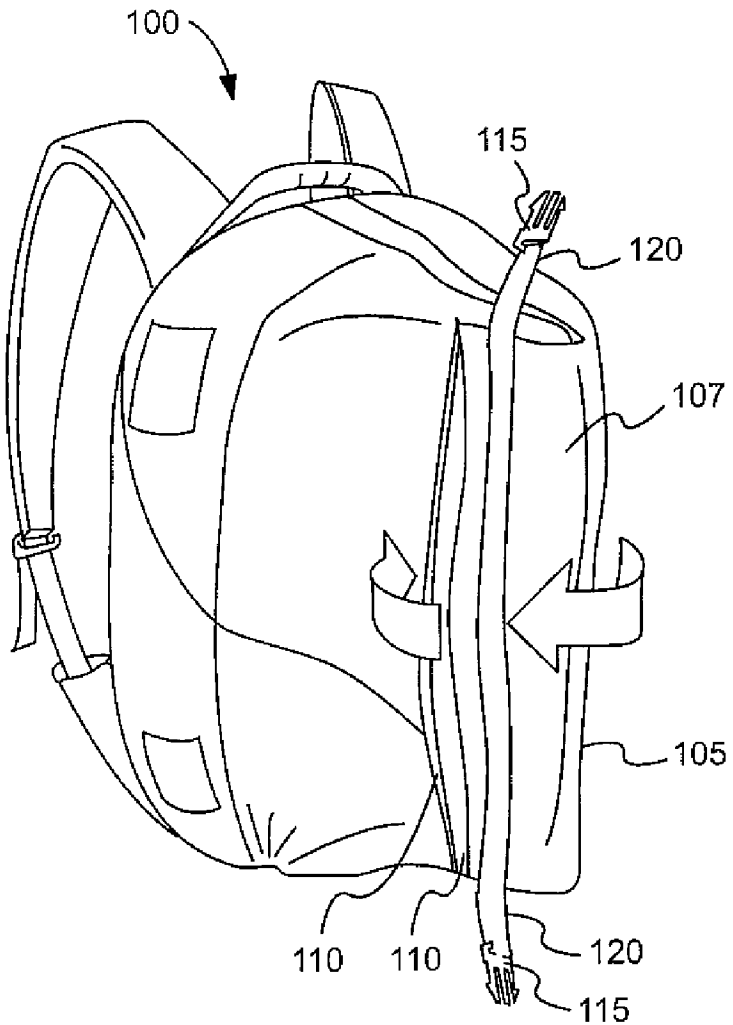

FIGS. 3A and 3B illustrates backpack 100 and integrated waterproof dry bag 105 with roll top 107 in open and closed positions in accordance with one embodiment of the invention. As shown in FIG. 3A, open dry bag 105 features roll top 107, seal 110, top buckles 115, top straps 120, bottom buckles 125 (not shown), and bottom straps 130 (not shown). In an open position, seal 110 is brought together. To seal the bag, seal 110 is brought together to form a band at the top of dry bag 105. As shown in FIG. 3B, roll top 107 is rolled in one direction several times to create a waterproof barrier. Top buckles 115 (not shown) are drawn down around the sides of dry bag 105 and fastened to bottom buckles 125 (not shown). As such, the contents of dry bag 105 are completely waterproofed.

Figure 4:
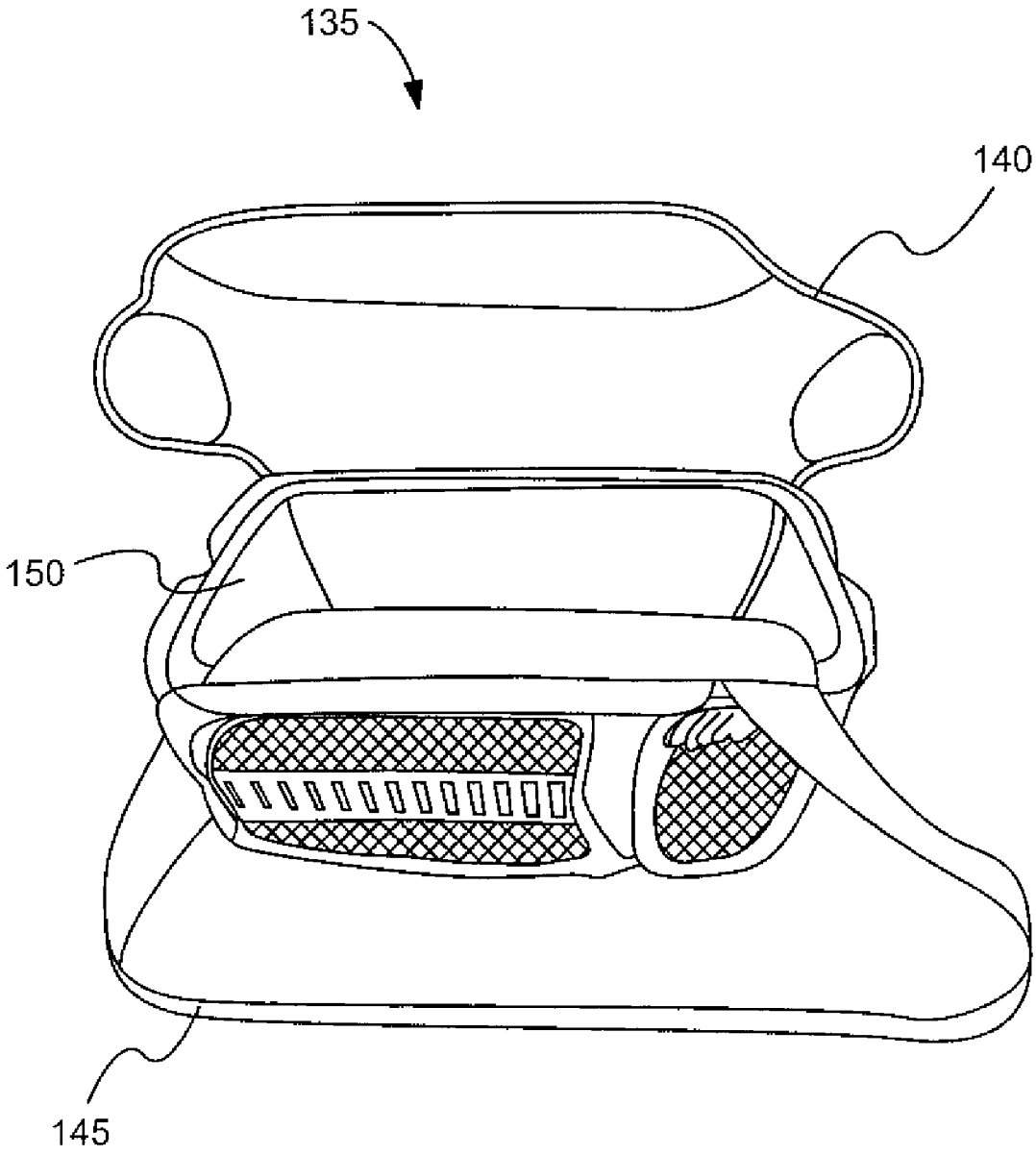
FIG. 4 illustrates a sling bag in stand alone configuration in accordance with one embodiment of the invention.

FIG. 4 illustrates a sling bag in stand alone configuration in accordance with one embodiment of the invention. Sling bag 135 features cover flap 140 and a single shoulder strap 145. A single strapped bag is commonly known as a "sling" in today's market. A single strap is typically used for a smaller, lighter bag that does not require the use of a more traditional two-strap setup. In accordance with one embodiment of the invention, the single strapped sling bag 135 advantageously allows the user to swing the bag around his body to conveniently access storage compartment 150.

When the user swings sling bag 135 around to the user's front, he can quickly and easily access the contents in storage compartment 150. In accordance with one embodiment of the invention, cover flap 140 over the sling bag is held entirely in place by a substantially large area of Velcro®. Zippers are an alternative method of closure as zippers offer a relatively secure fastening method, while Velcro® is typically thought of as less secure, but more convenient than a zipper for quick access. In a preferred embodiment of the invention, Velcro® is used advantageously because the main contents of sling bag 135 are typically stored in another enclosure, for example, in dry bag 105. Opening cover flap 140 allows a user access to dry bag 105 (not shown in FIG. 4) in addition to ancillary pouches and pockets. Although Velcro® is used in the preferred embodiment of the invention, zippers or any other common closure mechanism known in the industry may be utilized and contemplated in the scope of the invention.

Figure 5A:
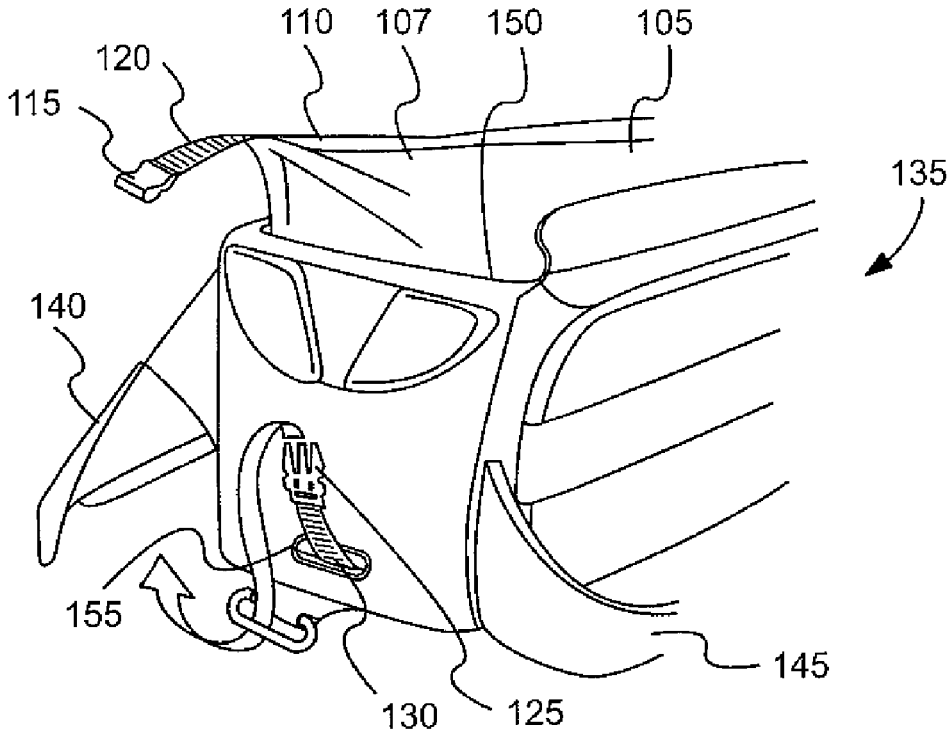
FIGS. 5A and 5B illustrates a sling bag and integrated waterproof dry bag with sling bag cover flap in an open position in accordance with one embodiment of the invention.
Figure 5B:
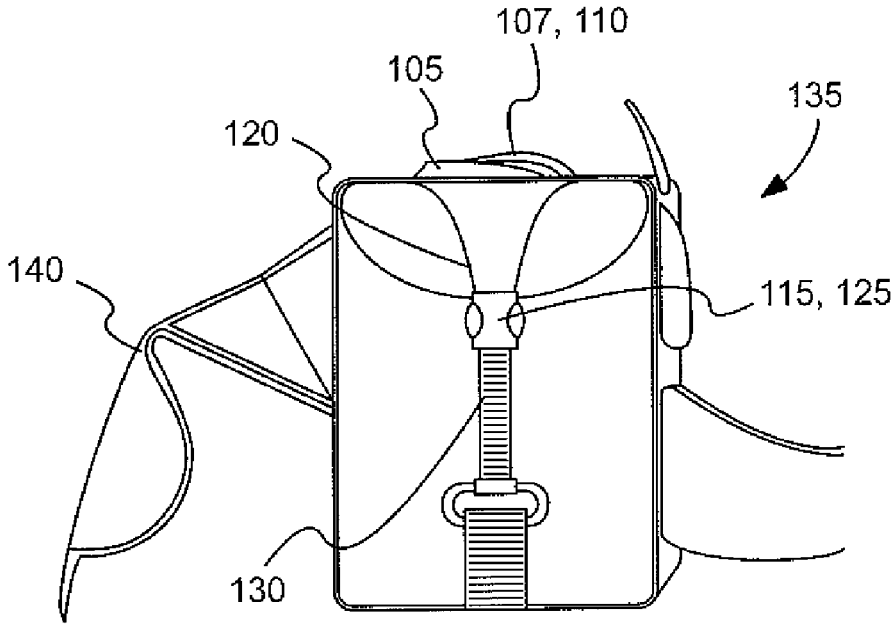

FIGS. 5A and 5B illustrates sling bag 135 and integrated waterproof dry bag 105 with sling bag cover flap 140 in an open position in accordance with one embodiment of the invention. In accordance with a preferred embodiment of the invention, dry bag 105 is of substantially the same size and shape as sling bag 135.

When cover flap 140 of sling bag 135 is open, the internal dry bag 105 is exposed. Dry bag 105 features roll top 107, seal 110, top buckle 115, top strap 120, bottom buckle 125, and bottom strap 130. Sling bag 135 features cover flap 140, sling strap 145, and openings 155. Openings 155 are at opposing sides of sling bag 135. As shown in FIG. 5A, when dry bag 105 is placed into storage compartment 150 of sling bag 135, dry bag 105 is properly seated into sling bag 135 when bottom buckles 125 and bottom straps 130 are pulled through openings 155

As shown in FIG. 5B, when top buckle 115 and bottom buckle 125 are fastened and top strap 120 and bottom strap 130 are drawn taut, the waterproof barrier of roll top 107 and seal 110 is strengthened and completely air tight.

In accordance to one embodiment of the invention, sling bag 135 employs traditional non-waterproof bag materials and sewing techniques because it is completely external and separate from dry bag 105. This makes the attachment of straps, pockets and pouches to the system easier and more cost effective, as these additions can be placed on sling bag 135 rather than dry bag 105. While sling bag 135 will naturally shed off water, dirt and other debris, the complete environmental protection is accomplished by dry bag 105.

Figure 6A:
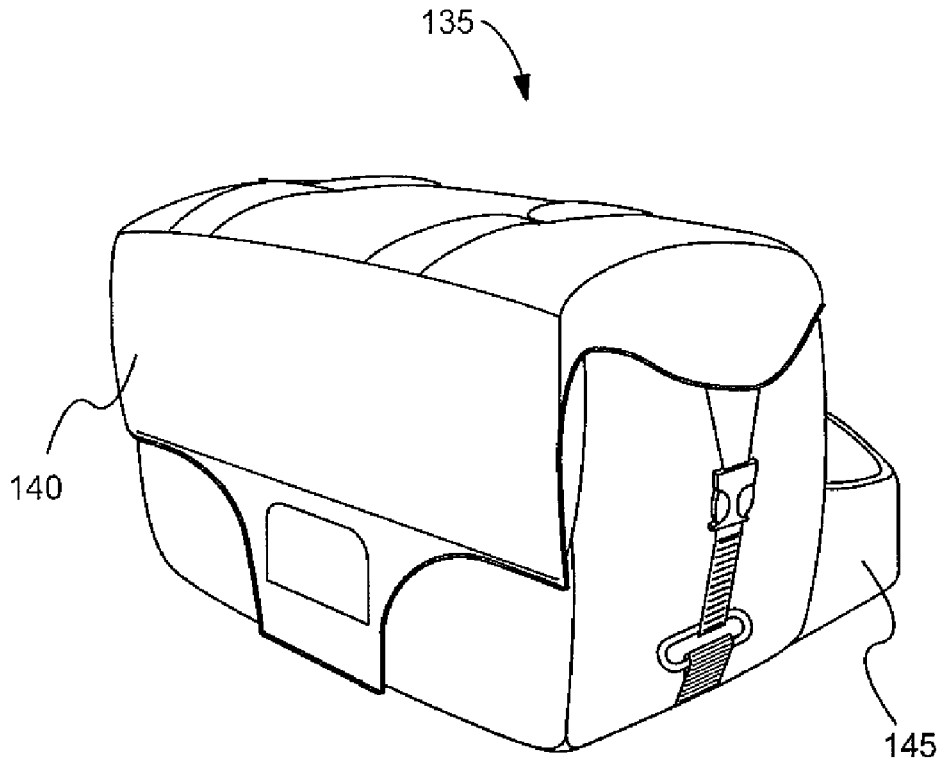
FIGS. 6A and 6B illustrates a sling bag and integrated waterproof dry bag with sling bag cover flap in a closed position in accordance with one embodiment of the invention.
Figure 6B:
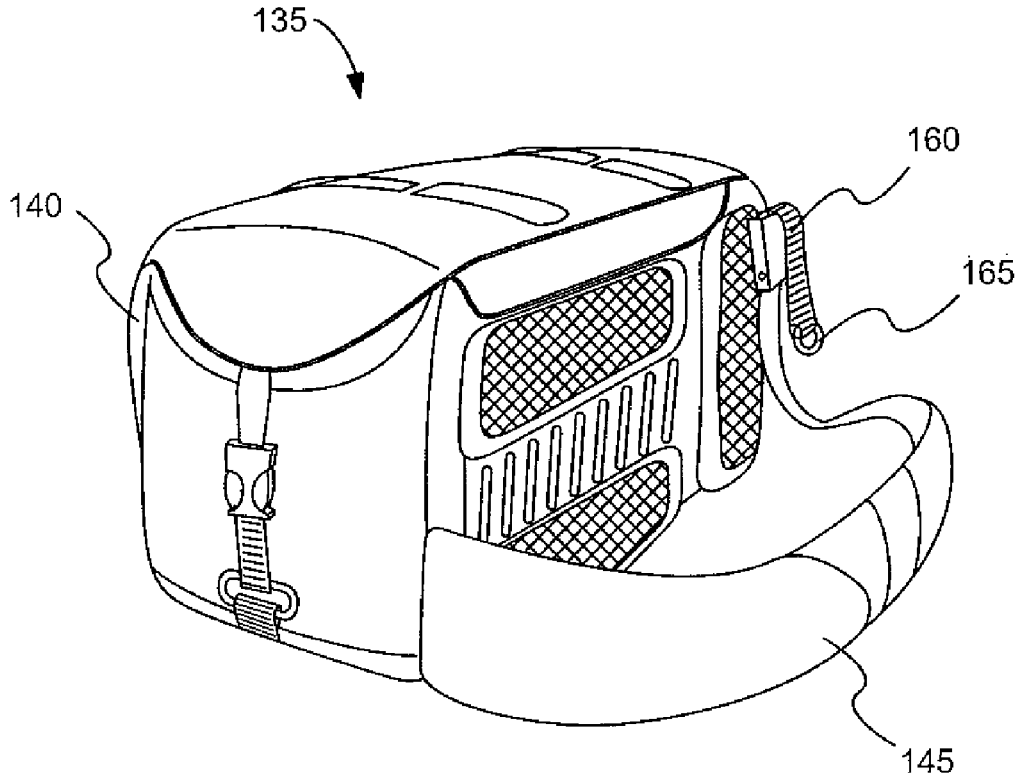

FIG. 6A illustrates sling bag 135 and integrated waterproof dry bag 105 (not shown) with sling bag cover flap 140 in a closed position in accordance with one embodiment of the invention. As shown in FIG. 6B, sling bag 135 features cover flap 140, sling strap 145, quick release 160 and stopper 165.

Because of the adjustment of the single sling strap 145, when the user swings sling bag 135 around to the user's front side, sling bag 135 may be presented too high to allow convenient access. In order to lower sling bag 135 quickly, sling strap 145 utilizes quick release 160. Quick release 160 may be a latch, tension mechanism or any other quick release mechanism known in the art. When the user pulls this quick release 160, sling strap 145 lengthens, thereby lowering sling bag 135 to a desired position. Sling strap 145 further features stopper 165 (a ring, fob, or other device) that prevents sling strap 145 from sliding through quick release 160 and dropping sling bag 135 to the ground.

What is claimed is:

1. A storage system, comprising:

a first enclosure that forms an outer carrier, wherein said outer carrier includes fastener openings; and a second enclosure that forms a inner carrier, wherein said inner carrier is stored within said outer carrier, wherein said inner carrier includes, an opening, a roll top mechanism, a first set of fasteners at opposite ends of said opening and disposed at a first end of said inner carrier, and a second set of fasteners disposed at a second end of said inner carrier opposite said first end, wherein said second set of fasteners are configured to engage said first set of fasteners, wherein said inner carrier includes an open configuration wherein said opening is open such that an interior of said inner carrier is accessible and a closed configuration wherein edges of said opening contact each other to close said opening and said roll top mechanism formed by the edges of the closed opening is rolled over at least one time, and wherein in the closed configuration said second set of fasteners of said inner carrier extend from an interior of said outer carrier to an exterior of said outer carrier through said fastener openings and are attached to said first set of fasteners of said inner carrier.

2. The system of claim 1, wherein said inner carrier is a waterproof elastomeric bag.

3. The system of claim 2, wherein the inner carrier further comprises:

a seal disposed around said opening and configured to close said opening, wherein, in the closed configuration, said seal closes said opening.

4. The system of claim 1, wherein said outer carrier includes one strap.

5. The system of claim 4, wherein said outer carrier is a sling bag.

6. A waterproof storage system, comprising:

a carrier; and an elastomeric enclosure of substantially the same size and shape of said carrier, wherein said elastomeric enclosure is integrated with said carrier, wherein said elastomeric enclosure comprises, an opening, a roll top mechanism, a first set of fasteners at opposite ends of said opening, and a second set of fasteners, wherein said elastomeric enclosure comprises an open configuration wherein said opening is open such that an interior of said elastomeric enclosure is accessible and a waterproofed configuration wherein edges of said opening contact each other to close said opening, said roll top mechanism formed by the edges of the closed opening is rolled over at least one time, said second set of fasteners of said elastomeric enclosure extend from an interior of said carrier to an exterior of said carrier through fastener openings in said carrier and are attached to said first set of fasteners of said elastomeric enclosure.

7. The system of claim 6, wherein said elastomeric enclosure further comprises:

adjustable straps connecting said elastomeric enclosure to said fasteners.

8. The system of claim 7, wherein in said waterproofed configuration said adjustable straps are tightened such that said adjustable straps are taut.

9. The system of claim 6, wherein said carrier is a backpack.

10. The system of claim 6, wherein said carrier is a sling bag.

11. A camera bag system, comprising:

a sling bag including fastener openings; and a waterproof bag of substantially the same size and shape of said sling bag, wherein said waterproof bag is stored within said sling bag and comprises compartment storage optimized for storage of camera equipment, wherein said waterproof bag comprises, an opening, a roll top mechanism, a first set of fasteners disposed at opposite ends of said opening of said waterproof bag and disposed at a first end of said waterproof bag, and a second set of fasteners disposed at a second end of said waterproof bag opposite said first end, wherein said second set of fasteners are configured to engage said first set of fasteners, and wherein said waterproof bag comprises an open configuration wherein said opening is open such that an interior of said waterproof bag is accessible and a closed configuration wherein edges of said opening contact each other to close said opening, said roll top mechanism formed by the edges of the closed opening is rolled over at least one time, and said second set of fasteners of said waterproof bag extend from an interior of said sling bag to an exterior of said sling bag through said fastener openings and are attached to said first set of fasteners of said waterproof bag.

12. The system of claim 11, wherein said waterproof bag is an elastomeric bag.

13. The system of claim 12, wherein said waterproof bag further comprises:

a seal disposed around said opening and configured to close said opening, wherein, in the closed configuration, said seal closes said opening.

14. The system of claim 6, wherein said elastomeric enclosure further comprises a seal disposed around said opening and configured to close said opening, wherein, in the closed configuration, said seal closes said opening.

* * * * *